US005978638A

United States Patent [19]

Tanaka et al.

[11] Patent Number: 5,978,638

[45] Date of Patent: Nov. 2, 1999

[54] INTERMEDIATE TRANSFER BELT AND IMAGE FORMING APPARATUS ADOPTING THE BELT

[75] Inventors: Atsushi Tanaka, Susono; Minoru Shimojo, Kawasaki; Akira Shimada, Shizuoka-ken; Hiroyuki Osada, Numazu; Tsunenori Ashibe, Yokohama, all of Japan

[73] Assignee: Canon Kabushiki Kaisha, Tokyo, Japan

[21] Appl. No.: 08/960,449

[22] Filed: Oct. 29, 1997

[30] Foreign Application Priority Data

Oct. 31, 1996 [JP] Japan ..... 8-305700

[51] Int. Cl.[6] ..... G03G 15/01; G03G 15/16

[52] U.S. Cl. ..... 399/302; 399/308

[58] Field of Search ..... 399/297, 298, 399/302, 308; 430/126

[56] References Cited

U.S. PATENT DOCUMENTS

| | | | |
|---|---|---|---|
| 5,132,743 | 7/1992 | Bujese et al. | 399/302 |
| 5,409,557 | 4/1995 | Mammino et al. | 399/308 |
| 5,669,052 | 9/1997 | Kusaba et al. | 399/308 |
| 5,715,510 | 2/1998 | Kusaba et al. | 399/308 |
| 5,745,830 | 4/1998 | Fujiwara et al. | 399/308 |
| 5,752,130 | 5/1998 | Tanaka et al. | 399/308 X |
| 5,761,595 | 6/1998 | Tarnawskyj et al. | 399/308 |

FOREIGN PATENT DOCUMENTS

| | | |
|---|---|---|
| 57-2046 | 1/1982 | Japan . |
| 62-206567 | 9/1987 | Japan . |
| 63-301960 | 12/1988 | Japan . |
| 1-273075 | 10/1989 | Japan . |
| 3-192282 | 8/1991 | Japan . |
| 3-293385 | 12/1991 | Japan . |
| 5-40417 | 2/1993 | Japan . |
| 6-161292 | 6/1994 | Japan . |
| 8-5480 | 2/1996 | Japan . |

*Primary Examiner*—William Royer

*Attorney, Agent, or Firm*—Fitzpatrick, Cella, Harper & Scinto

[57] ABSTRACT

The present invention concerns an image forming apparatus for forming a toner image on a transfer medium by use of an intermediate transfer belt, and also the intermediate transfer belt itself. The intermediate transfer belt has an elastic layer JIS-A hardness of which is 85° or less and at least one covering layer formed on the elastic layer. A relative permittivity $\epsilon$ and thickness t ($\mu$m) of the at least one covering layer satisfy relations of $\epsilon \leqq 6$ and $t \geqq \epsilon$, and the intermediate transfer belt includes a fiber. The effects of this $\epsilon$ value and the fiber inside enabled to suppress scattering of toner well.

17 Claims, 5 Drawing Sheets

FIG. 7
CONVENTIONAL
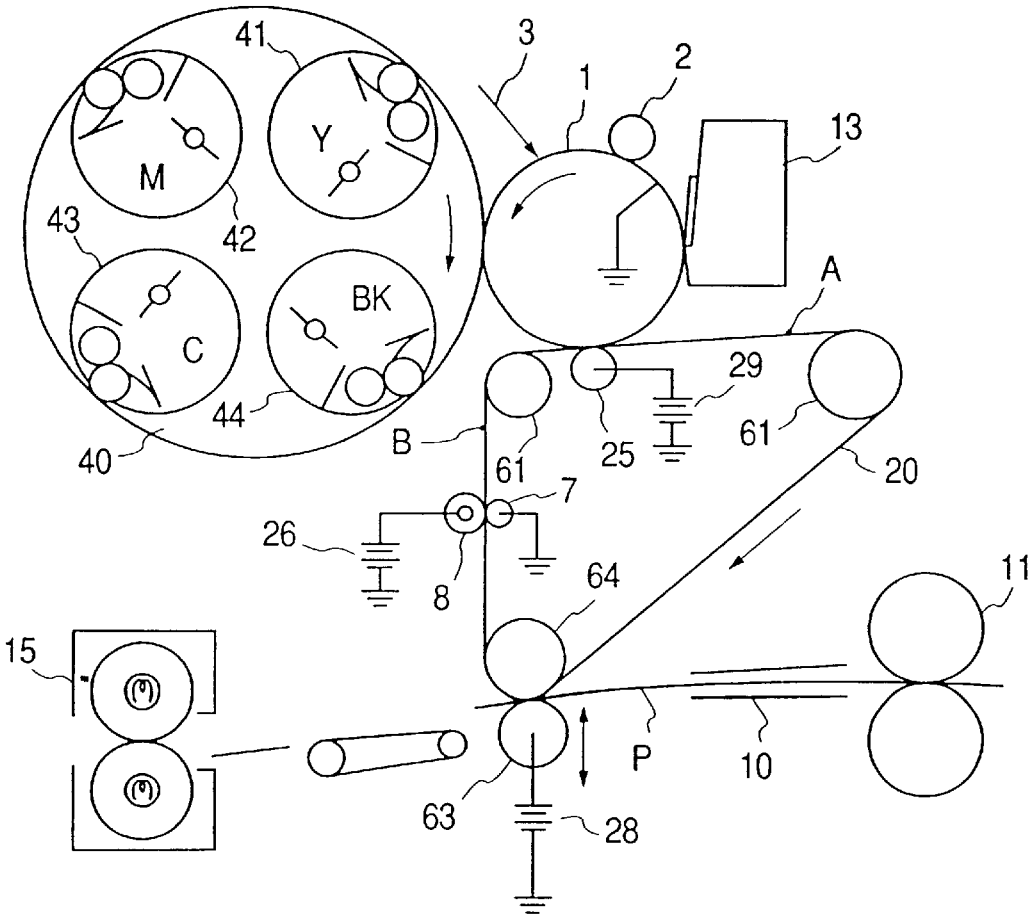

INTERMEDIATE TRANSFER BELT AND IMAGE FORMING APPARATUS ADOPTING THE BELT

BACKGROUND OF THE INVENTION

1. Field of the Invention

The present invention relates to an image forming apparatus employing the electrophotographic method and, more particularly, the invention relates to an image forming apparatus for obtaining an image-formed article by transferring a toner image formed on a first image bearing member onto an intermediate transfer belt and again transferring the image onto a transfer medium as being a second image bearing member.

2 . Related Background Art

Image forming apparatus incorporating the intermediate transfer belt is well known and is effectively applicable to color image forming apparatus and multi-color image forming apparatus for successively transferring and stacking a plurality of component color images based on color image information or multi-color image information to synthetically reproduce a color image or a multi-color image, thereby obtaining an image-formed article, or to image forming apparatus provided with such color image forming function or multi-color image forming function.

An example of the image forming apparatus incorporating the conventional intermediate transfer belt is schematically shown in FIG. 7. This image forming apparatus is constructed as a color image forming apparatus (a copier or a laser beam printer) of the electrophotographic process having the intermediate transfer belt 20. This intermediate transfer belt 20 is made of an elastic member of medium resistance.

The image forming apparatus is provided with an electrophotographic, photosensitive member of a drum shape (hereinafter referred to as "a photosensitive drum") 1 as a first image bearing member and this photosensitive drum 1 is driven to rotate at a predetermined peripheral velocity (process speed) in the direction of the arrow.

The photosensitive drum 1 is uniformly charged in predetermined polarity and potential by primary charger 2 during the rotating process thereof, and is then exposed to image exposure light 3 by image exposure means not illustrated. This forms an electrostatic, latent image corresponding to a first color component image (for example, a yellow color component image) of an aimed color image.

Then the electrostatic, latent image is developed at a developing position by first developing unit (yellow developing unit) 41 to be visualized as a yellow toner image. At this time second to fourth developing units, i.e. magenta developing unit 42, cyan developing unit 43, and black developing unit 44, are kept unoperated so as not to act on the photosensitive drum 1, so that the yellow toner image is not subject to the action of the second to fourth developing units 42 to 44. The first to fourth developing units 41 to 44 are mounted so as to be rotatable on support member 40 and are successively moved to the developing position opposed to the photosensitive drum 1.

The intermediate transfer belt 20 is looped over two rollers 61 and roller 64 and is then driven to rotate at the same peripheral velocity and in the same direction of movement at the opposed portion in contact with the photosensitive drum 1 as the photosensitive drum 1 does. Primary transfer roller 25 is located at a position inside the intermediate transfer belt 20 in the contact portion with the photosensitive drum 1, whereby a primary charging bias from bias supply 29 is applied through the primary transfer roller 25 to the intermediate transfer belt 20. The primary transfer bias is of the opposite polarity to toner and the applied voltage is, for example, in the range of +100 V to +2 kV.

The yellow toner image formed on the photosensitive drum 1 is successively transferred to the outside peripheral surface of intermediate transfer belt 20 by a primary transfer electric field created by the primary transfer bias applied from the primary transfer roller 25 to the intermediate transfer belt 20, during passage through the contact nip portion between the photosensitive drum 1 and the intermediate transfer belt 20 (primary transfer).

The photosensitive drum 1, after completion of transfer of the yellow toner image of the first color onto the intermediate transfer belt 20, is cleaned by cleaning unit 13 to remove the residual toner remaining on the surface after the primary transfer and is thereafter subjected to image forming processes to follow the primary charging. Then a magenta toner image of the second color, a cyan toner image of the third color, and a black toner image of the fourth color are formed in the same manner to be transferred as successively stacked on the intermediate transfer belt 20, thereby obtaining a synthetic color image corresponding to the aimed color image.

The roller 64 supporting the intermediate transfer belt 20 is a secondary transfer opposite roller and secondary transfer roller 63 is arranged as retractable at a position on the outside periphery of the intermediate transfer belt 20 where the roller 64 is located. A secondary charging bias is applied from bias supply 28 to the secondary transfer roller 63. The secondary transfer roller 63 can be spaced away from the intermediate transfer belt 20 during the primary transfer steps of the toner images of the first color to the third color.

The secondary transfer bias is applied from the bias supply 28 to the secondary transfer roller 63 at the timing when the toner images of the four colors transferred in superimposed fashion on the intermediate transfer belt 20 reach the vicinity of the secondary transfer portion by rotation of the intermediate transfer belt 20. At the same time, the secondary transfer roller 63 is brought into contact with the intermediate transfer belt 20. Further, a transfer medium (paper or resin sheet) P as a second image bearing member is fed at predetermined timing to the contact portion by sheet feed roller 11 to be supplied thereto through guide 10.

The toner images of the four colors on the intermediate transfer belt 20 are successively transferred together onto the surface of transfer medium P by a secondary transfer electric field created by the secondary transfer bias applied from the secondary transfer roller 63 to the intermediate transfer belt 20, during passage through the contact nip portion between the intermediate transfer belt 20 and the secondary transfer roller 63 (secondary transfer). The transfer medium P after the secondary transfer of the four-color toner images is then guided to fixing unit 15, in which it is heated and pressed to fuse and mix the four-color toner components and to fix them on the transfer medium P, thereby forming a full-color printed image.

The toner of secondary transfer residue remaining on the surface of the intermediate transfer belt 20 is charged in the opposite polarity to the photosensitive drum 1 by belt cleaner 8. The belt cleaner 8 is comprised of a roller arranged as retractable on the outside periphery of the intermediate transfer belt 20. The secondary transfer residue toner is charged to the predetermined polarity by applying a cleaning bias of the predetermined polarity to the belt cleaner 8 by bias supply 26 while keeping the belt cleaner 8 in contact with the surface of the intermediate transfer belt 20 and using earthed conductive roller 7 as an opposed pole located inside the intermediate transfer belt 20. In this example the photosensitive drum 1 is charged in the negative polarity, and the secondary transfer residual toner is thus charged in the positive polarity. The belt cleaner 8 can be spaced away from the intermediate transfer belt 20 during the primary transfer steps of the toner images of the first color to the third color.

The secondary transfer residual toner charged in the opposite polarity on the intermediate transfer belt 20 is electrostatically attracted to the photosensitive drum 1 in the contact portion of the intermediate transfer belt 20 therewith and in the vicinity thereof, thereby being removed from the intermediate transfer belt 20.

The above color image forming apparatus incorporating the intermediate transfer belt can transfer the toner image from the intermediate transfer belt to the transfer medium without a need for any control on the transfer medium (for example, gripping the transfer medium by a gripper of transfer drum, attaching the transfer medium onto the surface of transfer drum, giving the transfer medium curvature along the surface of transfer drum, etc.), when compared with the color image forming apparatus arranged to stick or attach the transfer medium onto the transfer drum for carrying it and to transfer a toner image of each color from the photosensitive drum onto the transfer medium to obtain a color image, for example, as described in Japanese Laid-open Patent Application No. 63-301960. Therefore, the above apparatus has such an advantage that the color image can be obtained by transferring of the toner image, regardless of whether the width is wide or narrow or whether the length is long or short, ranging from thin paper of about 40 $g/m^2$ to thick paper of 200 $g/m^2$, such as an envelope, a post card, or a label sheet.

Because of this advantage, the color image forming apparatus incorporating the intermediate transfer belt is already in operation as a color copier, a color printer, or the like.

The conventional image forming apparatus incorporating the intermediate transfer belt, however, had the following problems, though having the above advantage; (1) void image often appears as shown in FIG. 8; (2) because of expansion and contraction of the intermediate transfer belt 20 at the portion of roller 61 as shown in FIG. 9 (FIG. 9 schematically shows the expansion and contraction of intermediate transfer belt 20 by illustrating stripes at equal intervals in the cross section of intermediate transfer belt 20) and mechanical vibration transferred to the intermediate transfer belt 20, the primary transfer toner is readily scattered from the intermediate transfer belt 20 during rotation thereof (scattering on the belt), which degrades the quality of image.

SUMMARY OF THE INVENTION

An object of the present invention is to provide an image forming apparatus incorporating an intermediate transfer belt, capable of obtaining an image with high quality without void image and without scattering of toner on the belt. The present invention achieving the above object provides an image forming apparatus for forming a toner image on a transfer medium by use of an intermediate rotary member. Said apparatus comprises an image bearing member, toner image forming means for forming a toner image on the image bearing member, an intermediate transfer belt arranged to move on an endless basis in contact with the image bearing member, first transfer means for primarily transferring the toner image formed on the image bearing member onto the intermediate transfer belt at a first transfer position of the intermediate transfer belt and second transfer means provided between the intermediate transfer belt and the first transfer means for secondarily transferring the toner image having been transferred to the intermediate transfer belt, onto the transfer medium at a second transfer position of the intermediate transfer belt. Wherein the intermediate transfer belt has an elastic layer JIS-A hardness of which is 85° or less and at least one covering layer formed on the elastic layer, wherein specific permittivity $\epsilon$ and thickness t ($\mu$m) of the at least one covering layer satisfy relations described below:

$\epsilon \leqq 6$ and $t \geqq \epsilon$, and wherein the intermediate transfer belt comprises a fiber.

The present invention also provides the intermediate transfer belt itself, used in the above image forming apparatus.

BRIEF DESCRIPTION OF THE DRAWINGS

FIG. 7 is a schematic drawing to show the color image forming apparatus incorporating the conventional intermediate transfer belt;

DETAILED DESCRIPTION OF THE PREFERRED EMBODIMENTS

Figure 1:
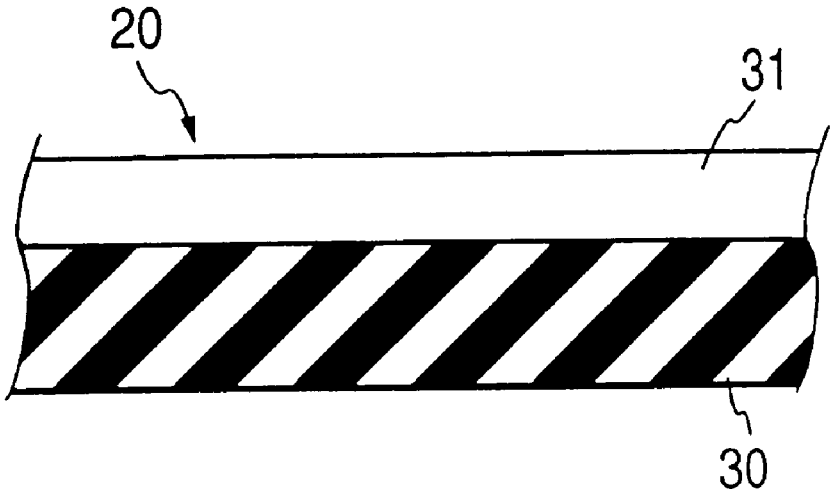
FIG. 1 is a cross-sectional view to show an intermediate transfer belt in an embodiment of the present invention.

The present invention will be described in detail. The present invention is mainly characterized by the structure of the intermediate transfer belt of the image forming apparatus and the other structure of the image forming apparatus is basically the same as the conventional image forming apparatus shown in FIG. 7. Accordingly, the following description will refer to FIG. 7 if necessary.

As described previously, the conventional intermediate transfer belt had the following problems; (1) the void image readily occurred; (2) because of the expansion and contraction of the intermediate transfer belt in the roller portion and the mechanical vibration transferred to the intermediate transfer belt, scattering occurred on the belt.

The inventors produced a variety of intermediate transfer belts by coating the elastic layer of rubber of various hardnesses with a resin having high releasability to the toner to form a covering layer thereon and investigated the above problem (1) therewith. We obtained the result that void images were more likely to be produced in the case of hard elastic layers. Based on this result, we succeeded in solving the problem of void image by lowering the hardness of the elastic layer.

Specifically, the problem of void image was solved by employing such hardness of the elastic layer that JIS-A hardness thereof was 85° or less. There is no lower limit of the hardness of elastic layer for preventing the void image. However, in view of (a) the fact that hardnesses of rubber according to ordinary formulations are not less than 30° and (b) the fact that rubber of less than 30° can be made by blending a large amount of plasticizer or the like therein and that bleeding-out of plasticizer heavily pollutes the photosensitive member (which generates cracks in the photosensitive member to degrade the quality of image), a practical range of hardness is between 30° and 85°, preferably between 50° and 80°, and more preferably between 60° and 75°.

Next, a possible countermeasure against the above problem (2) is to harden the intermediate transfer belt or to thicken the roller. These means can decrease the expansion and contraction of the intermediate transfer belt in the roller portion, but they have drawbacks of increasing the size of a driving system due to increase in driving torque and increasing the size of a belt stretching system due to the increase in the diameter of roller. In addition, it is hard to perfectly cut off the mechanical vibration transferred to the intermediate transfer belt.

Accordingly, in order to reduce the scattering on the belt without degradation of quality of image and without increase in the size of apparatus, the toner having primarily been transferred onto the intermediate transfer belt needs to be fixed by some means. The inventors studied a method for electrostatically fixing the toner having primarily been transferred onto the intermediate transfer belt.

First, the inventors measured surface potentials of the intermediate transfer belt 20 during the primary transfer operation in the image forming apparatus shown in FIG. 7. The photosensitive drum 1 was uniformly negatively charged by the primary charger 2 and exposed to image exposure light 3 and the latent image was visualized by inversion development to deposit the toner of negative charge on bright portions exposed to the image exposure light 3. Then the positive voltage was applied to the primary transfer roller 25, thereby primarily transferring the toner image visualized from the latent image onto the intermediate transfer belt 20.

Points of measurement of surface potential on the transfer belt 20 were point A immediately after the primary transfer on the downstream side of the photosensitive drum 1 and point B sufficiently apart therefrom in the direction of rotation of the intermediate transfer belt, as shown in FIG. 7. In this case point B is located at a position downstream of the belt cleaner 8, but, because we are not discussing cleaning of the intermediate transfer belt 20 herein, the belt cleaner 8 does not operate this time, of course, so that the belt cleaner 8 does not act on the surface potential of the intermediate transfer belt 20 at all.

Figure 5:
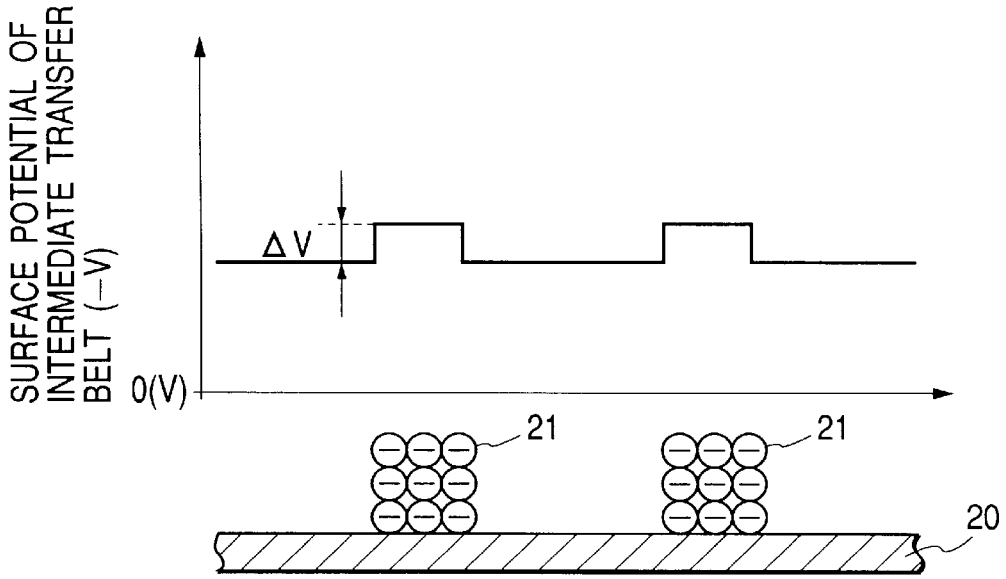
FIG. 5 is a drawing to show the surface potential of the intermediate transfer belt at point A of the image forming apparatus of FIG. 7.
Figure 6:
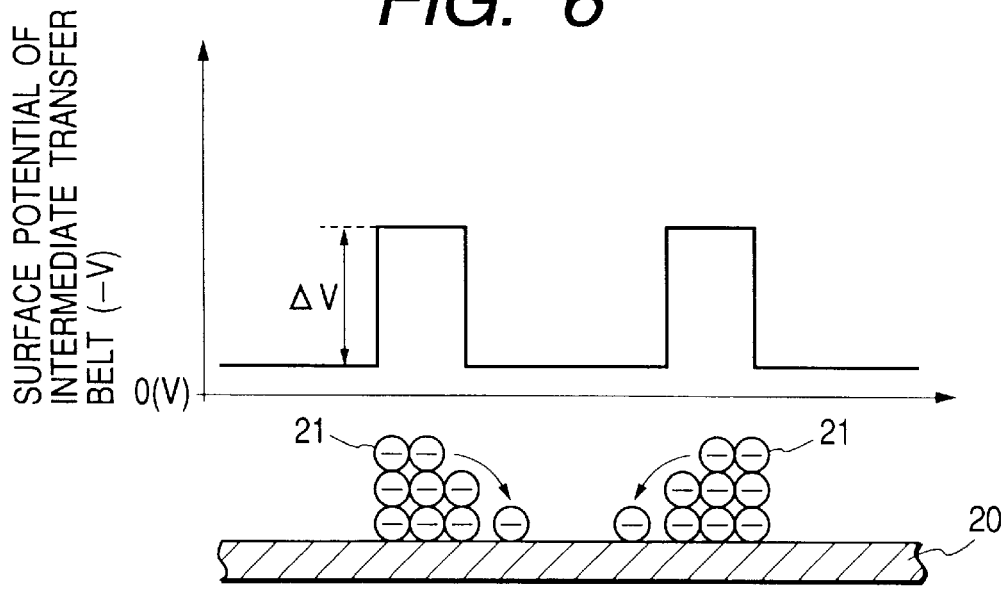
FIG. 6 is a drawing to show the surface potential of the intermediate transfer belt at point B of the image forming apparatus of FIG. 7.
Figure 8:
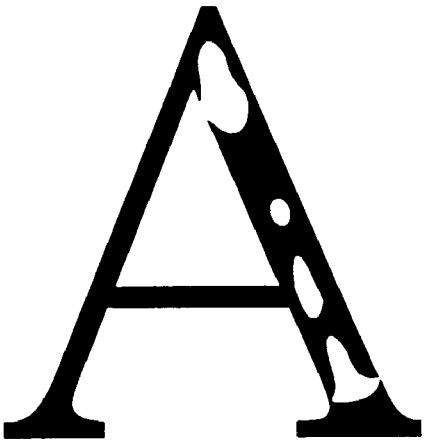
FIG. 8 is an explanatory drawing to show the void image made by the image forming apparatus of FIG. 7.

The result of measurement of the surface potential at point A is shown in FIG. 5 and the result of measurement of surface potential at point B in FIG. 6.

At point A, i.e., at the position immediately after the primary transfer, non-image portions (portions where the toner 21 was not laid) in the surface of the intermediate transfer belt 20 had a negatively large potential as shown in FIG. 5. This is presumably because the intermediate transfer belt 20 received the negative charge from the photosensitive drum 1 upon the primary transfer. Image portions (portions where the toner 21 was laid) in the surface of the intermediate transfer belt 20 also had a negative potential because of the negative charge of the toner 21 itself.

On the other hand, at point B sufficiently apart from the primary transfer position, as shown in FIG. 6, the surface potential of the non-image portions of the intermediate transfer belt 20 was greatly lowered because of attenuation of charge, while the surface potential of the image-portions was little lowered because of very slow attenuation of charge of toner 21. As a result, a difference $\Delta V$ of surface potential between the image portions and non-image portions of the intermediate transfer belt 20 at point B was great.

It is thus considered that the toner 21 having the negative charge became easier to move from the image portions to the non-image portions along electric force lines directed from the non-image portions to the image portions in such a state of the great difference $\Delta V$ of surface potential between the image portions and non-image portions. It was presumed that when the intermediate transfer belt 20 passed the roller portion in this state, the toner readily moved to the non-image portions because of the expansion/contraction and mechanical vibration of the intermediate transfer belt 20, thereby causing the so-called scattering on the belt.

From the above result, the inventors contemplated that the above surface potential difference $\Delta V$ should be decreased in order to electrostatically fix the primarily transferred toner on the intermediate transfer belt thereon to stop the scattering on the belt. This is, however, not the case when the absolute value i.e., |the potential of non-image portion|>the absolute value i.e., |the potential of image portion| as a preferred example (larger $\Delta V$ is more preferred in this case). Namely, when $\alpha$ is a positive number, the relation of $$(|\text{the potential of image portion}|-\alpha)<|\text{the potential of non-image portion}|$$

is desirably made to hold for the minimum value of $\alpha$.

As described above, it was found that the surface of the intermediate transfer belt received the charge from the photosensitive drum upon the primary transfer to be charged negatively. There are two approaches conceivable for decreasing the surface potential difference $\Delta V$; (a) raising the potential of the intermediate transfer belt (the potential of non-image portion) immediately after the primary transfer (point A); (b) delaying the attenuation of charge received.

First, let us discuss the approach (a). The quantity of charge received from the photosensitive drum is defined by primary transfer current. Assuming that the quantity of charge is constant, the surface potential $V_0$ of the intermediate transfer belt immediately after the primary transfer is inversely proportional to capacitance C of the intermediate transfer belt.

$$\text{Namely, } V_0=Q/C \tag{1}$$

where

Q: the quantity of charge received from the photosensitive drum, and $$C=\alpha\epsilon/t \tag{2}$$

where $\alpha$: a constant of proportion, $\epsilon$: relative permittivity of the intermediate transfer belt, and t: the thickness of the intermediate transfer belt.

Therefore, $$V_0=Q/C=Qt/\alpha\epsilon=\beta t/\epsilon \quad (3)$$

where $\beta$=a constant of proportion (=$Q/\alpha$).

Next discussed is the approach (b). Letting V(x) be a surface potential of the intermediate transfer belt x seconds after the primary transfer and R be a resistance of the intermediate transfer belt, the following relation holds.

$$V(x)=V_0 \exp(-x/CR) \quad (4)$$

Substituting Eq. (2) into the above relation, $$V(x)=V_0 \exp(-xt/\alpha\epsilon R) \quad (5)$$

Here, it is seen from Eq. (3) and Eq. (5) that contributions of relative permittivity $\epsilon$ and thickness t to (a) and (b) are reverse. Namely, smaller $\epsilon$ and larger t are advantageous for raising the surface potential of non-image portion $V_0$ of the intermediate transfer belt immediately after the primary transfer in (a); whereas larger $\epsilon$ and smaller t are advantageous for delaying the attenuation of charge received in (b).

Intermediate transfer belts having a covering layer (one layer) of various relative permittivities $\epsilon$ and thicknesses t on an electrically conductive, elastic layer were produced and incorporated in the image forming apparatus shown in FIG. 7. Then experiments of formation of image were carried out to evaluate the scattering on the belt. As a result, the following facts were found.

(1) When the covering layer has $\epsilon>6$, a lot of scattering occurs on the belt. Accordingly, such intermediate transfer belts cannot be used in practice.

(2) When the covering layer has $\epsilon\leqq 6$, the degree of scattering on the belt depends upon the thickness t ($\mu$m). Namely, when $t\geqq\epsilon$, the scattering on the belt is little. Such intermediate transfer belts can be used in practice.

When $t<\epsilon$, the scattering on the belt is a lot. Thus, such intermediate transfer belts cannot be used in practice.

The above experiment results can be interpreted as follows. Namely, when the relative permittivity of the covering layer $\epsilon>6$, the non-image portion potential $V_0$ of the intermediate transfer belt immediately after the primary transfer becomes smaller, as seen from Eq. (3). The lowering of $V_0$ can be prevented by increasing the thickness t of the covering layer, but the attenuation of charge represented by Eq. (5) becomes very quick, because materials of $\epsilon>6$ normally have small resistance R (usually, when $\epsilon$ is doubled, R decreases by one figure or more). In fact, the non-image portion potential of the surface of intermediate transfer belt at point B was almost 0 V. This leads us to such contemplation that when $\epsilon>6$, Eq. (5) becomes dominant to make the attenuation of charge very quick, this increases the difference $\Delta V$ of surface potential between the non-image portions and image portions at point B, and thus the scattering occurs on the belt while failing to electrostatically fix the toner of image portion on the intermediate transfer belt.

On the other hand, when $\epsilon\leqq 6$, $V_0$ can be increased by properly increasing the value of the thickness t of the covering layer. Since materials of relative permittivity $\epsilon\leqq 6$ of the covering layer have large resistance R, the attenuation of charge is slow and thus Eq. (5) does not have to substantially take into consideration. Namely, when $\epsilon\leqq 6$, Eq. (3) becomes dominant. If $\epsilon$ is small and t is large (if $\epsilon/t\geqq 1$ according to the above experiments), the potential difference $\Delta V$ between the non-image portions and image portions at point B can be decreased. We concluded that, because the toner of image portion was electrostatically fixed on the intermediate transfer belt, the scattering on the belt was able to be prevented.

In the present invention, based on the above, the intermediate transfer belt 20 is constructed in the structure of the covering layer 31 formed on the elastic layer 30 as shown in FIG. 1, the elastic layer 30 has JIS-A hardness of 85° or less, the relative permittivity $\epsilon$ of the covering layer 31 is 6 or less ($\epsilon\leqq 6$), and the thickness t ($\mu$m) of the covering layer 31 is not less than the value of relative permittivity $\epsilon$ ($t\geqq\epsilon$).

In the present invention, the thickness of the covering layer 31 is 200 $\mu$m or less. If the thickness of the covering layer 31 is over 200 $\mu$m, durability of the covering layer will greatly be degraded and cracking will become easier to occur in the covering layer.

The thickness of the elastic layer 30 is between 300 $\mu$m and 3000 $\mu$m. If the thickness of the elastic layer is less than 300 $\mu$m, formation of the elastic layer will not be easy in terms of accuracy of thickness, strength, and cost. If the thickness is over 3000 $\mu$m, rigidity of the elastic layer will appear prominent and will make smooth rotation of the intermediate transfer belt difficult. The volume resistivity of the elastic layer 30 is preferably $1\times10^{11}$ Ωcm or less and more preferably $7\times10^{8}$ Ωcm or less.

In the present invention, intermediate transfer belts having two or more covering layers were further prototyped and evaluated in the same manner. As a result, we found that as long as the intermediate transfer belt has at least one layer of the covering layer satisfying $\epsilon\leqq 6$ and $t\geqq\epsilon$, the scattering on the belt can be prevented regardless of positions of the specific covering layer. This also presents an advantage of largely expanding the width of selection of material for forming the covering layer.

For example, the intermediate transfer belt may be constructed in such structure that the first covering layer on the elastic layer is made of a material having tackiness though $\epsilon\leqq 6$, for example styrene-butadiene rubber, and the second covering layer (the surface layer) on the first covering layer is made of a resin with good releasability though $\epsilon>6$, for example polyether polyurethane. This intermediate transfer belt can also prevent the scattering on the belt without losing the effect of the first covering layer.

The resin with good releasability in the present invention means any resin satisfying the following conditions; black toner is put in an amount of 0.5 to 1 g/cm$^2$ on the resin, a cleaning wiper (trade name; Dusper available from Ozu Sangyo) is moved back and forth ten times, then the black toner is removed (the pressure upon removing is 100 to 150 g/cm$^2$ and a new face of the cleaning wiper is used for each go and back wiping), the resin is adhered to a one-side adhesive tape of colorless polyester to transfer the residual toner thereto, the tape is peeled off and stuck to white CLC paper (available from CANON INC.), and a reflection density of black of the tape on the CLC paper is measured by a reflection densitometer (Macbeth Model No. 1151 SPI available from Macbeth Inc.); when a measured value of the reflection density of black (which is a value including all of the CLC paper, the adhesive tape, and the black toner adhesively transferred) is 0.15 or less, the resin is defined as a resin with good releasability.

Figure 2:
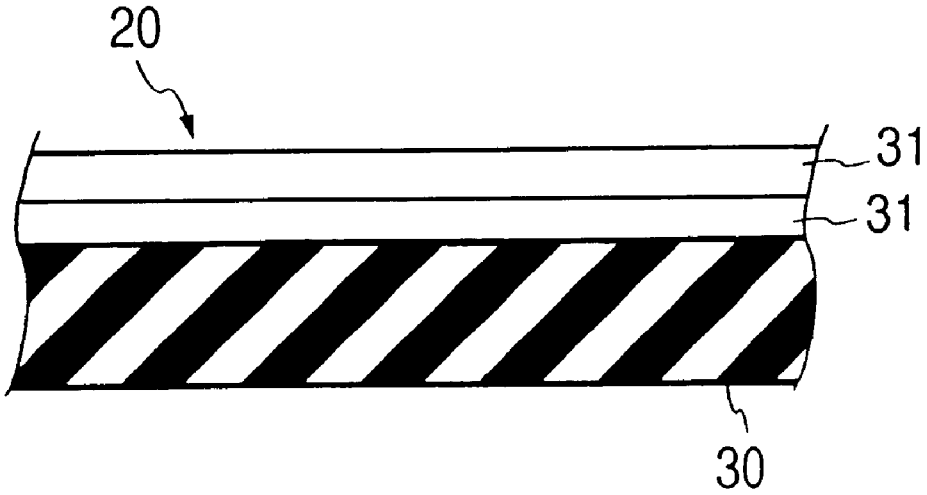
FIG. 2 is a cross-sectional view to show an intermediate transfer belt in another embodiment of the present invention

Therefore, according to another embodiment of the present invention, the intermediate transfer belt 20 comprises two or more covering layers 31 on the elastic layer 30 as shown in FIG. 2, JIS-A hardness of the elastic layer 30 is 85° or less, the relative permittivity $\epsilon$ of at least one of the covering layers 31 is $\epsilon \leqq 6$, and the thickness $t \geqq \epsilon$.

As for the conventional technology, Japanese Laid-open Patent Application No. 57-2046 proposed an intermediate transfer medium provided with an insulating thin film on an electrically conductive support, but this proposal failed to take the relative permittivity and the thickness of the insulating thin film into consideration. Therefore, the scattering on belt will occur.

An embodiment described in Japanese Laid-open Patent Application No. 3-192282 proposed the intermediate transfer belt comprised of a semiconductive layer of polyester and a polyethylene surface layer of the thickness 50 $\mu$m, but the intermediate transfer belt of this proposal has the conductive layer of resin and has no elastic layer. Therefore, a void image will be produced.

Similarly, an embodiment described in Japanese Laid-open Patent Application No. 5-40417 proposed the intermediate transfer belt having an electroconductive, elastic layer and a surface layer of solvent-soluble fluororesin of 5 to 30 $\mu$m, but this proposal failed to take the hardness of the electroconductive, elastic layer into consideration. Therefore, a void image will also be produced.

Further, an embodiment described in Japanese Laid-open Patent Application No. 1-273075 proposed the intermediate transfer belt in which a covering layer of tetrafluoroethylene (Teflon) of the relative permittivity $\epsilon=2$ was provided on the elastic layer of urethane rubber. This proposal, however, fails to take the hardness of the elastic layer and the thickness of the covering layer into consideration. Accordingly, the scattering on belt and the void image will appear.

Further, Japanese Laid-open Patent Application No. 62-206567 proposed the intermediate transfer medium wherein the resistivity of the image-carrier-side surface was $1\times10^{12}$ Ωcm or less or in which the relative permittivity of the image-carrier-side surface was 3 or more. However, the intermediate transfer medium of this proposal has no elastic layer. Further, nothing is specified as to the relation between relative permittivity and thickness. Therefore, the scattering on belt and the void image will appear.

Further, an embodiment described in Japanese Laid-open Patent Application No. 5-1429955 proposed the intermediate transfer drum in which a dielectric layer of polycarbonate containing dispersed carbon black for adjustment of resistance was provided on an aluminum cylinder. However, the drum of this proposal has no elastic layer, so that the void image will appear. In addition, nothing is considered about the thickness and relative permittivity of the dielectric layer. Although consideration is given to the resistance of the dielectric layer, the resistance is low, $10^7$ to $10^{11}$ Ωcm, and the attenuation of potential of non-image portion is fast. Thus, the scattering on belt will appear.

Similarly, Japanese Laid-open Patent Application No. 6-161292 proposed the intermediate transfer medium having the volume resistivity of $10^6$ to $10^{12}$ Ωcm. However, the transfer member of this proposal has no elastic layer, either, and the void image will appear. Further, nothing is considered as to the thickness and relative permittivity of the dielectric layer. Although the resistance of the dielectric layer is taken into consideration, the value of resistivity is low, $10^6$ to $10^{12}$ Ωcm, and the attenuation of potential of non-image portion is thus quick. Therefore, the scattering on the belt will occur.

In the present invention, the relative permittivities of covering layer were measured under the following conditions:

Measuring instrument: 4284A PRCION LCR METER (manufactured by Hewlett Packard) and electrode for measurement of dielectric 16451B (electrode C) (available from Hewlett Packard)

Measuring method: the electrode contact method as described in the instruction manual of the electrode for measurement of dielectric 16451B Dimensions of sample: the outside diameter of thin film guard electrode=56 mm, the inside diameter of thin film guard electrode=51 mm, the diameter of thin film main electrode=50 mm, and thickness of sample=15 to 50 $\mu$m Method for forming thin film electrode: vapor deposition by Pt—Pd electrode (available from Hitachi Science Systems) for mild sputter E1030

Measuring conditions: 1 Vpp, 100 Hz

Ambience of measurement: 23° C./60%.

In the present invention the hardness of elastic layer (JIS-A hardness) was obtained by the method pursuant to the durometer hardness test (type A) described in JIS-A 6253.

The intermediate transfer belt 20 is preferably reinforced by fibers, because the reinforcement by fibers can prevent sagging (lowering of tension) due to repetitive use.

Figure 3:
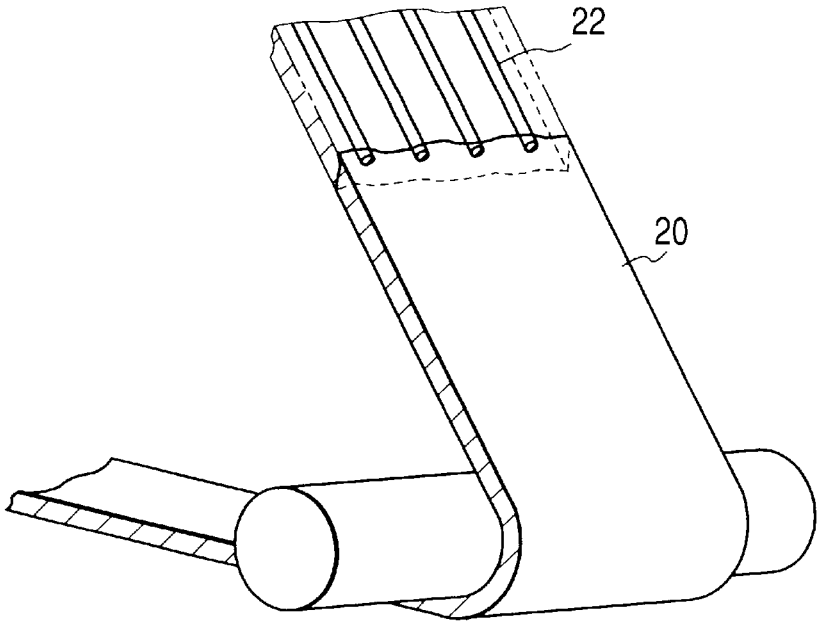
FIG. 3 is a perspective view to show an arrangement method of fibers for reinforcing the intermediate transfer belt in the present invention.
Figure 4:
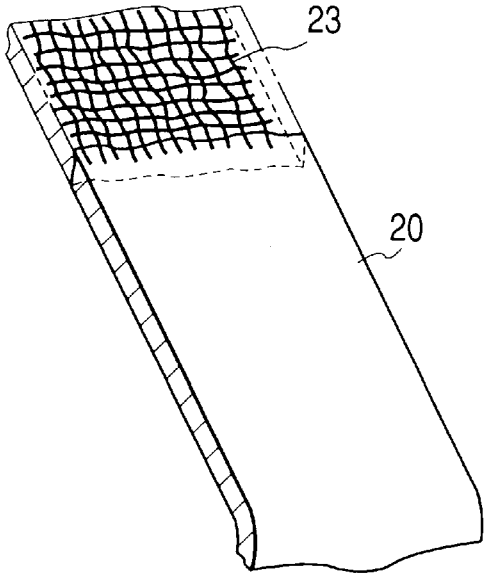
FIG. 4 is a perspective view to show another arrangement method of fibers for reinforcing the intermediate transfer belt in the present invention.

The reinforcement of the intermediate transfer belt by fibers may be done by a method of spiral arrangement of fiber 22 in which filaments of fiber 22 extend along the longitudinal direction of the intermediate transfer belt 20 (in the direction of rotation thereof) as shown in FIG. 3 or by a method of arrangement in which fabric 23 of woven fiber is buried in the intermediate transfer belt 20 as shown in FIG. 4. The most preferred arrangement of fiber is the spiral arrangement of fiber 22 from the viewpoints of easiness of manufacturing and the manufacturing cost. The position of arrangement can be determined arbitrarily, for example, in the lower surface or in the internal lower portion of the elastic layer in the intermediate transfer belt 20.

In the present invention, specific examples of the fibers used for the reinforcement of the intermediate transfer belt include, though not being intended to be limited to these, natural fibers such as cotton, silk, hemp, or wool; regenerated fibers such as chitin fibers, alginate fibers, or regenerated cellulose fibers; semi-synthetic fibers such as acetate fibers; synthetic fibers such as polyester fibers, polyamide fibers, acrylic fibers, polyolefin fibers, polyvinyl alcohol fibers, polyvinyl chloride fibers, polyvinylidene chloride fibers, polyurethane fibers, aramid fibers, or polyfluoroethylene fibers; inorganic fibers such as carbon fibers, glass fibers, or boron fibers; metallic fibers such as steel fibers or copper fibers; and so on. Fibers of one or two or more species of these may be applied.

The fibers may be of one filament or a plurality of strand filaments. The strand thread may be obtained by any strand method. Further, the strand thread may also be of mix spinning.

The woven fabric may be any woven fabric woven by any weaving method, for example, by knitting or the like, and union fabric can also be used.

The technique for reinforcing the intermediate transfer belt by fibers is also disclosed, for example, in U.S. Pat. No. 5,409,557, Japanese Laid-open Patent Application No. 3-293385, and so on, but these do not take the relative permittivity of the material for the intermediate transfer belt into consideration at all. Therefore, the scattering on belt will occur. Similarly, Japanese Utility Model Publication No. 8-5480 does not take the relative permittivity and thickness of covering layer into consideration at all, as well as the large relative permittivity of 10 or more of the entire intermediate transfer belt, so that the potential difference $\Delta V$ between the image portions and non-image portions of the surface of intermediate transfer belt is large. Therefore, the scattering on the belt will occur.

In the present invention, the elastic layer and covering layer of the intermediate transfer belt are made of rubber, elastomer, or resin. Examples of the rubber and elastomer are as follows, though not being intended to be limited to these. Specific examples thereof include natural rubber, isoprene rubber, styrene-butadiene rubber, butyl rubber, ethylene-propylene terpolymer, chloroprene rubber, chlorosulfonated polyethylene, acrylonitrile butadiene rubber, urethane rubber, epichlorohydrin rubber, silicone rubber, fluororubber, and hydrogenated nitrile rubber. Examples of thermoplastic elastomer include polyethylene-based, polyolefin-based, polyurethane-based, polyester-based, and fluororesin-based elastomers. One or two or more species can be selected from these materials.

Although not being intended to be limited to these, specific examples of the resin include polystyrene, styrene-based resin (polychlorostyrene, styrene-butadiene copolymers, etc.), methyl methacrylate resin, ethyl acrylate resin, modified acrylic resin (silicone-modified acrylic resin, acryl-urethane resin, etc.), polyvinyl chloride resin, phenol resin, epoxy resin, polyester resin, polyester polyurethane resin, polyethylene, polypropylene, polybutadiene, polyvinylidene chloride, polyurethane resin, silicone resin, fluororesin, modified polyphenylene oxide resin, and so on. One or two or more species selected from these can be used.

The method for forming the covering layer can be arbitrarily selected from spray coating, dip coating, electrostatic coating, extrusion molding, and so on.

For controlling the resistance of the intermediate transfer belt to a desired value, a conductive agent may be added to the elastic layer and coating layer, if necessary. There is no specific limitation on the conductive agent, but specific examples of the conductive agent include carbon, metal powder of aluminum, nickel, or the like, metallic oxides such as titanium oxide, conductive polymer compounds such as polymethyl methacrylate containing quaternary ammonium salt, polyvinyl aniline, polyvinyl pyrrole, polydiacetylene, polyethylene imine, polymer compounds containing boron, and polypyrrole, and so on. One or two or more species selected from these can be used.

Since the image forming apparatus of the present invention is constructed so as to resist occurrence of scattering on the belt, use of the photosensitive drum containing fine powder of PTFE (polytetrafluoroethylene) at least in the outermost layer will result in more perfect primary transfer without occurrence of scattering on the belt even if the transfer is carried out at higher primary transfer efficiency (that is, even if the toner is transferred in greater thicknesses on the intermediate transfer belt). Therefore, it is preferable in respect of the quality of image.

As described above, according to the present invention, the intermediate transfer belt is comprised of the elastic layer and at least one covering layer, the relative permittivity $\epsilon$ and thickness t ($\mu$m) of the at least one covering layer satisfy the relations of $\epsilon \leqq 6$ and $t \geqq \epsilon$, and JIS-A hardness of the elastic layer is 85° or less. Owing to this, the elastic layer of the intermediate transfer belt can prevent the void image, the covering layer satisfying the above specific relations increases the absolute value of surface potential of non-image portion of the intermediate transfer belt immediately after the primary transfer, and the attenuation of charge at the position apart therefrom is delayed, thereby making the difference of surface potential smaller between the image portions and non-image portions. Therefore, the toner having primarily been transferred onto the intermediate transfer belt can be electrostatically fixed on the intermediate transfer belt. Accordingly, high-definition images can be obtained without void image and without scattering on the belt.

Examples of the present invention will be described.

EXAMPLE 1

A cylindrical mold was covered by a rubber compound preliminarily extruded in a tube shape and polyester threads of the diameter 150 $\mu$m were wound thereon in a spiral form so that spaces between adjacent threads were approximately 0.7 mm. The tube was further placed thereon and polyester tape was wound thereon to sufficiently fit the rubber compound to the mold. Then the rubber compound was vulcanized. After the vulcanization, the polyester tape was peeled off and the rubber was polished, thereby obtaining the elastic layer (the tube of elastic body) in which fibers were arranged.

The material formulation of the rubber compound was as described below. The material formulation is indicated by parts by weight (which is also the case in the following).

| | |
|---|---|
| NBR | 70 parts |
| EPDM | 30 parts |
| vulcanizing agent (precipitated sulfur) | 1.5 parts |
| vulcanizing assistant (zinc white) | 2 parts |
| vulcanization accelerator (MBT) | 1.5 parts |
| vulcanization accelerator (TMTM) | 1.2 parts |
| conductive agent (carbon black) | 25 parts |
| dispersion assistant (stearic acid) | 1 part |
| plasticizer (naphthene-based process oil) | 40 parts |

JIS-A hardness of the elastic layer thus obtained was 65° and the volume resistivity thereof was $1\times10^7$ Ωcm.

Then a coating for forming the covering layer on the above elastic layer was made according to the following formulation.

The formulation is indicated by parts by weight (which is also the case in the following).

| | |
|---|---|
| polycarbonate-based polyurethane | 100 parts |
| PTFE resin powder | 70 parts |
| fluorine-based graft copolymer | 3 parts |
| methyl ethyl ketone | 500 parts |
| methyl isobutyl ketone | 200 parts |
| N-methyl pyrolidone | 100 parts |

The above coating was applied onto the elastic layer and dried by set to touch at room temperature. Thereafter, it was heated at 130° C. for two hours to remove residual solvent, thereby obtaining the intermediate transfer belt having one covering layer of the relative permittivity $\epsilon$=2.7 and the thickness t=18 $\mu$m on the elastic layer.

This intermediate transfer belt was mounted on the color image forming apparatus of FIG. 7 to be used for formation of full-color image. Image formation was carried out under the following image-forming conditions and the primary transfer efficiency at that time was measured.

Surface potential of non-image portion of photosensitive drum: −550 V

Surface potential of image portion of photosensitive drum: −150 V

Color developer: non-magnetic one-component toner (for each of the four colors)

Primary transfer voltage: +500 V

Secondary transfer current: +10 μA

Process speed: 120 mm/sec

Development bias: Vdc=−400 V

Vac=1600 Vpp, frequency 1800 Hz

In the present invention the primary transfer efficiency of image was defined as follows.

Primary transfer efficiency=density of toner image on intermediate transfer belt/(density of toner image remaining after transfer on photosensitive drum+density of toner image on intermediate transfer belt)

The scattering and void were evaluated under the above image-forming conditions. The results are shown in Table 1. The results showed, as shown in Table 1, that high-definition full-color print images were obtained without occurrence of void image and with very little scattering on the belt. It was further verified that even after operation of formation of 5000 images, decrease in the tension of the intermediate transfer belt was small and the belt was not loosened.

The following can be contemplated as a reason why the scattering on the belt was very little in the present embodiment.

Since in the present embodiment the relative permittivity ϵ of the covering layer is sufficiently small, 2.7, and the thickness t thereof is large, 18 μm, the electrostatic fixing effect of toner by the covering layer is considered to act greatly. Further, since the intermediate transfer belt is reinforced by fibers, the scattering is considered to be decreased more because of decrease in the following factors.

Figure 9:
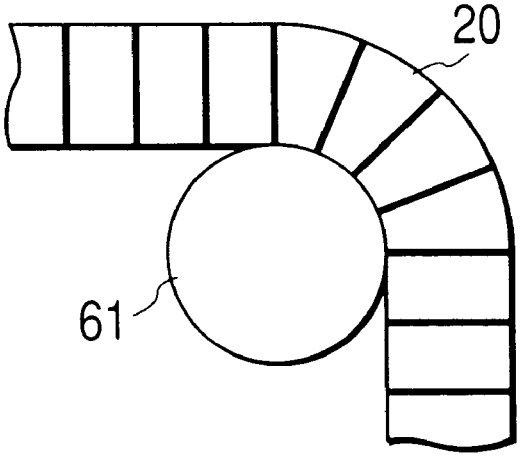
FIG. 9 is an explanatory drawing to show the expansion and contraction in the roller portion of the intermediate transfer belt in the image forming apparatus of FIG. 7.

(1) The factor of mechanical scattering caused by the difference in elongation percentage of intermediate transfer belt between the tension side (the upstream side of the driving roller) and the loose side (the downstream side of the driving roller) during rotation of intermediate transfer belt (2) The factor of mechanical scattering caused by expansion and contraction of the surface of intermediate transfer belt (the toner carrying surface) before and after passage through the roller portion as shown in FIG. 9.

According to the studies by the inventors, however, the scattering cannot be improved so great even with the reinforcement of intermediate transfer belt by fibers, if the relative permittivity and thickness of covering layer are not appropriate. From this fact, it is presumed that the scattering level achieved by the present embodiment is not simply the sum of the electrostatic fixing effect by the covering layer and the mechanical scattering factor decreasing effect by the fibers, but it is achieved by the synergistic effect thereof. The synergistic effect is considered to be an effect to enhance the electrostatic fixing effect by delaying the attenuation of surface potential of non-image portion, because inclusion of fibers inside the elastic layer narrows paths for passage (attenuation) of the charge present in the non-image portions (the surface) of the intermediate transfer belt, for example. This synergistic effect first appears when the relative permittivity of covering layer is 6 or less, that is, when the attenuation of surface potential is slow. The synergistic effect is considered to be enhanced more as the relative permittivity of covering layer decreases and as the thickness of covering layer increases, i.e., as the attenuation of surface potential of non-image portion becomes slower.

TABLE 1

| | JIS-A Hardness of | Covering layer | | | | Efficiency of primary |
|---|---|---|---|---|---|---|
| | elastic layer | first layer | second layer | Void image | Scattering on belt | transfer (%) |
| Ex 1 | 65 | ϵ = 2.7 t = 18 μm | No | No | ⊚ | 94 |
| Ex 2 | 60 | ϵ = 3.5 t = 10 μm | ϵ = 6.5 t = 20 μm | No | ○ | 98 |
| Ex 3 | 85 | ϵ = 5.0 t = 30 μm | No | No | ○ | 92 |
| Ex 4 | 60 | ϵ = 6.0 t = 25 μm | No | No | ○ | 94 |
| Comp Ex 1 | 60 | ϵ = 6.5 t = 20 μm | No | No | x | 93 |
| Comp Ex 2 | 60 | ϵ = 5.0 t = 3 μm | No | No | x | 92 |
| Comp Ex 3 | No elastic layer | ϵ = 5.0 t = 5 μm | No | Observed | ○ | 94 |

⊚: very good
○: good
x: no good for practical use

EXAMPLE 2

Cotton yarn the surface of which was coated with an adhesive was wound in a spiral form around the cylindrical mold, it was covered by a tubular rubber compound being the same rubber compound as in Example 1, and it was vulcanized and polished, thereby forming the elastic member with fibers therein. The fibers were arranged in the spiral form on the inside peripheral surface of the elastic layer.

This elastic layer was coated by spray coating with an aqueous dispersion of ethylene-vinyl acetate resin (relative permittivity ϵ=3.5) and it was dried, thereby forming the first covering layer of the thickness 10 μm.

Then it was coated by spray coating with a coating of the following formulation, for forming the second covering layer (surface layer) on the first covering layer.

| | |
|---|---|
| polyether urethane resin | 100 parts |
| fine powder of PTFE resin | 70 parts |
| fluorine-based graft copolymer (dispersing agent) | 3 parts |
| methyl ethyl ketone | 400 parts |
| N-methyl pyrolidone | 50 parts |

The coating on the first covering layer was dried by set to touch at room temperature and heated at 120° C. for 30 minutes to remove the residual solvent, thereby forming the second covering layer on the first covering layer.

This resulted in obtaining the fiber-reinforced intermediate transfer belt having the first covering layer of the relative permittivity ϵ=3.5 and the thickness t=10 μm on the elastic layer and the second covering layer of the relative permittivity ϵ=6.5 and the thickness t=20 μm thereon.

The intermediate transfer belt thus obtained was mounted on the color image forming apparatus of FIG. 7 to be used for formation of full-color image in the same manner as in Example 1 and the image formation was carried out under like image-forming conditions. The primary transfer efficiency at that time was measured. For achieving higher transfer efficiency, the photosensitive drum 1 was an OPC photosensitive drum containing the fine powder of PTFE in the outermost layer.

The results are shown in Table 1. Continuous printing of 5000 full-color images was carried out and it was verified that the higher primary transfer efficiency was achieved and high-quality full-color print images were obtained without void image and without occurrence of scattering on the belt. Since the intermediate transfer belt was reinforced by fibers, lowering of tension of intermediate transfer belt was little and the belt was not loosened even after the operation of formation of 5000 images.

EXAMPLE 3

The cylindrical mold was covered by a rubber compound preliminarily extruded in the tube shape and polyester threads of the diameter 150 $\mu$m were wound thereon in the spiral form. The tube was further placed thereon and polyester tape was wound thereon to sufficiently fit the rubber compound to the mold. Then the rubber compound was vulcanized. After the vulcanization, the polyester tape was peeled off and the rubber was polished, thereby obtaining the elastic layer (the tube of elastic body) in which fibers were arranged.

The material formulation of the rubber compound was as described below. The material formulation is indicated by parts by weight (which is also the case in the following).

| | |
|---|---|
| NBR rubber | 40 parts |
| EPDM rubber | 60 parts |
| vulcanizing agent (precipitated sulfur) | 1.5 parts |
| vulcanizing assistant (zinc white) | 2 parts |
| vulcanization accelerator (MBT) | 1.5 parts |
| vulcanization accelerator (TMTM) | 1.2 parts |
| conductive agent (carbon black) | 55 parts |
| dispersion assistant (stearic acid) | 1 part |

JIS-A hardness of the elastic layer thus obtained was 85° and the volume resistivity thereof was $5\times10^{6}$ Ωcm.

Then a coating for forming the covering layer on the above elastic layer was made according to the following formulation.

The formulation is indicated by parts by weight (which is also the case in the following).

| | |
|---|---|
| polyester polyurethane | 100 parts |
| fine powder of PTFE resin | 70 parts |
| fluorine-based graft copolymer (dispersing agent) | 3 parts |
| methyl ethyl ketone | 400 parts |
| N-methyl pyrolidone | 50 parts |

Then the coating formed in the above formulation was applied onto the elastic layer and dried by set to touch at room temperature. Thereafter, it was heated at 120° C. for two hours to remove the residual solvent, thereby obtaining the fiber-reinforced intermediate transfer belt having one covering layer of the relative permittivity $\epsilon$=5.0 and the thickness t=30 $\mu$m on the elastic layer.

The intermediate transfer belt thus obtained was mounted on the color image forming apparatus of FIG. 7 to be used for formation of full-color image in the same manner as in Example 1. Image formation was carried out under like image-forming conditions and the primary transfer efficiency at that time was measured.

The results are shown in Table 1. Continuous printing of 5000 full-color images was carried out and it was verified that high-quality full-color printed images were obtained without void image and without occurrence of scattering on the belt. Since the intermediate transfer belt was reinforced by fibers, lowering of tension of intermediate transfer belt was little and the belt was not loosened even after the operation of formation of 5000 images.

EXAMPLE 4

The cylindrical mold was covered by a rubber compound preliminarily extruded in the tube form, polyester threads coated with an adhesive were wound thereon in the spiral form, a tubular rubber compound was put thereon, the polyester tape was wound thereon to sufficiently fit the rubber compound to the mold, and it was vulcanized and polished, thereby obtaining the elastic layer with fibers therein. The fibers were arranged in the spiral form with respect to the axial direction in the central part with respect to the direction of thickness of elastic layer.

The material formulation of the rubber compound was as follows.

| | |
|---|---|
| NBR rubber | 40 parts |
| EPDM rubber | 60 parts |
| vulcanizing agent (precipitated sulfur) | 1.5 parts |
| vulcanizing assistant (zinc white) | 2 parts |
| vulcanization accelerator (MBT) | 1.5 parts |
| vulcanization accelerator (TMTM) | 1.2 parts |
| conductive agent (carbon black) | 55 parts |
| dispersion assistant (stearic acid) | 1 part |

JIS-A hardness of the elastic layer thus obtained was 80° and the volume resistivity thereof was $5\times10^{11}$ Ωcm.

Then a coating for forming the covering layer on the above elastic layer was made according to the following formulation.

| | |
|---|---|
| polyester polyol | 100 parts |
| isocyanate (HDI) | 10 parts |
| fine powder of PTFE resin | 70 parts |
| fluorine-based graft copolymer (dispersing agent) | 3 parts |
| methyl ethyl ketone | 400 parts |
| N-methyl pyrolidone | 50 parts |

The elastic layer was coated by spray coating with the above coating, it was dried by set to touch at room temperature, and thereafter it was heated at 140 ° C. for one hour to complete the curing reaction of the covering layer, thereby obtaining the fiber-reinforced intermediate transfer belt having one covering layer of the relative permittivity= 6.0 and the thickness t=25 $\mu$m on the elastic layer.

The intermediate transfer belt thus obtained was mounted on the color image forming apparatus of FIG. 7 to be used for formation of full-color image in the same manner as in Example 1. Image formation was carried out under like image-forming conditions and the primary transfer efficiency at that time was measured.

The results are shown in Table 1. Continuous printing of 5000 full-color images was carried out and it was verified that high-quality full-color printed images were obtained without void image and without occurrence of scattering on the belt. Since the intermediate transfer belt was reinforced by fibers, lowering of tension of intermediate transfer belt was little and the belt was not loosened even after the operation of formation of 5000 images.

Comparative Example 1

The intermediate transfer belt was made by providing only the second covering layer without provision of the first covering layer on the elastic layer in Example 2.

This intermediate transfer belt was mounted in the image forming apparatus of FIG. 7 to be used for formation of full-color image in the same manner as in Example 1. Image formation was carried out under like image-forming conditions and the primary transfer efficiency at that time was measured. The results are shown in Table 1.

As shown in Table 1, the scattering on the belt occurred, because the relative permittivity of the covering layer of intermediate transfer belt was large, $\epsilon=6.5$.

Comparative Example 2

The intermediate transfer belt was made in the same manner as in Example 3 except that the thickness of the covering layer was 3 $\mu$m. It was mounted in the image forming apparatus of FIG. 7 to be used for formation of image and the primary transfer efficiency was measured.

As shown in Table 1, since the thickness t was thin, 3 $\mu$m, though the relative permittivity $\epsilon$ of the covering layer was not more than 6, the capacitance C of the covering layer was large and the scattering on the belt occurred.

Comparative Example 3

The intermediate transfer belt was made by providing the same covering layer as in Example 3 on an endless belt of polyester resin containing carbon black (the volume resistivity $10^6$ Ωcm and the thickness 200 $\mu$m).

Similarly, this intermediate transfer belt was mounted in the image forming apparatus of FIG. 7 to be used for formation of full-color image and the image formation was carried out under like image-forming conditions. The primary transfer efficiency at that time was measured.

As shown in Table 1, since the relative permittivity of the covering layer was 5.0 and the thickness thereof was 5 $\mu$m, the scattering on the belt did not occur; however, since there was no elastic layer in the intermediate transfer belt, the void image occurred.

As described above, the present invention is such that, for transferring the toner image formed on the image bearing member being the first image bearing member, onto the intermediate transfer belt and thereafter transferring the toner image onto the transfer medium being the second image bearing member to obtain an image thereon, the structure of the intermediate transfer belt is the structure comprising the elastic layer the JIS-A hardness of which is 85° or less and at least one covering layer formed thereon and the relative permittivity $\epsilon$ and thickness t ($\mu$m) of the at least one covering layer satisfy $\epsilon \leqq 6$ and $t \geqq \epsilon$. Accordingly, the elastic layer prevents the void image, the covering layer increases the surface potential at the position immediately after the primary transfer of the intermediate transfer belt, the attenuation of charge is delayed at the position apart therefrom, thereby decreasing the difference of surface potential between the image portions and non-image portions, and the toner having primarily been transferred is fixed on the intermediate transfer belt, thereby obtaining the high-quality image without scattering of toner on the belt.

Speaking of the lower limit of the above relative permittivity ($\epsilon$), experiments confirmed that it might be not more than 4.0 or not more than 3.5 and that a usable level was approximately 2.3.

What is claimed is:

1. An image forming apparatus for forming a toner image on a transfer medium by use of an intermediate rotary member, comprising:

an image bearing member;

toner image forming means for forming a toner image on the image bearing member;

an intermediate transfer belt for moving on an endless basis in contact with the image bearing member;

first transfer means for primarily transferring the toner image formed on the image bearing member onto the intermediate transfer belt at a first transfer position of the intermediate transfer belt; and second transfer means, provided between the intermediate transfer belt and the first transfer means, for secondarily transferring the toner image having been transferred onto the intermediate transfer belt, onto the transfer medium at a second transfer position of the intermediate transfer belt;

wherein said intermediate transfer belt has an elastic layer JIS-A hardness of which is 85° or less and at least one covering layer formed on said elastic layer; relative permittivity e and thickness t ($\mu$m) of said at least one covering layer satisfy the following relations:

$\epsilon \leqq 6$ and $t \geqq \epsilon$; and the intermediate transfer belt comprises a fiber.

2. An image forming apparatus according to claim 1, wherein said intermediate transfer belt comprises the fiber arranged in a spiral form along a direction of movement of the intermediate transfer belt.

3. An image forming apparatus according to claim 2, wherein a surface for supporting toner having been transferred onto said intermediate transfer belt has sufficient releasability from the toner.

4. An image forming apparatus according to either one of claims 1 to 3,wherein volume resistivity of said elastic layer is $1\times10^{11}$ Ωcm or less.

5. An image forming apparatus according to either one of claims 1 to 3,wherein said image bearing member is an electrophotographic photosensitive member, and an outermost layer of said photosensitive member contains fine powder of tetrafluoroethylene resin.

6. An image forming apparatus according to claim 4, wherein said image bearing member is an electrophotographic photosensitive member, and an outermost layer of said photosensitive member contains fine powder of tetrafluoroethylene resin.

7. An image forming apparatus according to claim 6, wherein said toner is non-magnetic one-component toner.

8. An image forming apparatus for forming a toner image on a transfer medium by use of an intermediate rotary member, comprising:

an electrophotographic photosensitive member;

toner image forming means for forming a toner image on the electrophotographic photosensitive member;

an intermediate transfer belt for moving on an endless basis in contact with the electrophotographic photosensitive member;

a first bias applying unit for forming a first transfer bias between said electrophotographic photosensitive member and the intermediate transfer belt, for primarily transferring the toner image formed on the electrophotographic photosensitive member onto the intermediate transfer belt at a first transfer position of the intermediate transfer belt; and a second bias applying unit for forming a second transfer bias between the intermediate transfer belt and a transfer unit, for secondarily transferring the toner image having been transferred onto the intermediate transfer belt, onto the transfer medium at a second transfer position of the intermediate transfer belt;

wherein said intermediate transfer belt has an elastic layer JIS-A hardness of which is 85° or less and at least one covering layer formed on said elastic layer, wherein relative permittivity e and thickness t ($\mu$m) of said at least one covering layer satisfy the following relations:

$$\epsilon \leqq 6 \text{ and } t \geqq \epsilon; \text{ and}$$

the intermediate transfer belt comprises a fiber.

9. An image forming apparatus according to claim 8, wherein said intermediate transfer belt comprises the fiber arranged in a spiral form along a direction of movement of the intermediate transfer belt.

10. An image forming apparatus according to claim 9, wherein a surface for supporting toner having been transferred onto said intermediate transfer belt has sufficient releasability from the toner.

11. An image forming apparatus according to either one of claims 7 to 9, wherein volume resistivity of said elastic layer is $1\times10^{11}$ Ωcm or less.

12. An image forming apparatus according to either one of claims 7 to 10, wherein an outermost layer of said photosensitive member contains fine powder of tetrafluoroethylene resin.

13. An image forming apparatus according to claim 11, wherein an outermost layer of said photosensitive member contains fine powder of tetrafluoroethylene resin.

14. An intermediate transfer belt used in an image forming apparatus for forming a toner image on a transfer medium, said intermediate transfer belt having an elastic layer JIS-A hardness of which is 85° or less and at least one covering layer formed on said elastic layer, characterized by that relative permittivity e and thickness t ($\mu$m) of said at least one covering layer satisfy the following relations:

$$\epsilon \leqq 6 \text{ and } t \geqq \epsilon; \text{ and}$$

the intermediate transfer belt comprises a fiber.

15. An intermediate transfer belt according to claim 14, said intermediate transfer belt comprising the fiber arranged in a spiral form along a direction of movement of the intermediate transfer belt.

16. An intermediate transfer belt according to claim 14 or 15, wherein a surface for supporting toner having been transferred onto said intermediate transfer belt has sufficient releasability from the toner.

17. An intermediate transfer belt according to either one of claims 14 to 15, wherein volume resistivity of said elastic layer is $1\times10^{11}$ Ωcm or less.

* * * * *

UNITED STATES PATENT AND TRADEMARK OFFICE

CERTIFICATE OF CORRECTION

PATENT NO. : 5,978,638

DATED : November 2, 1999

INVENTOR(S): ATSUSHI TANAKA, ET AL.

It is certified that error appears in the above-identified patent and that said Letters Patent is hereby corrected as shown below:

COVER PAGE AT ITEM [57] ABSTRACT:
Line 10, "enabled to suppress" should read --enables suppressing--.

COLUMN 1:
Line 18, "is well" should read --are well--.

COLUMN 3:
Line 5, "earthed" should read --a grounded--;
Line 23, "of" should read --of the--;
Line 25, "of" should read --of the--; and
Line 56, "of" should read --of the--.

COLUMN 5:
Line 31, 'roller." should read --the roller.--; and
Line 36, "increase" should read --an increase--.

COLUMN 7:
Line 53, "intermediate" should read --an intermediate--; and
Line 66, "take" should read --be taken--.

UNITED STATES PATENT AND TRADEMARK OFFICE

CERTIFICATE OF CORRECTION

PATENT NO. : 5,978,6[redacted]38

DATED : November 2, 1999

INVENTOR(S): ATSUSHI TANAKA, ET AL.

It is certified that error appears in the above-identified patent and that said Letters Patent is hereby corrected as shown below:

COLUMN 8:
Line 4, "of" should read --of the--;
Line 38, "such" should read --such a--; and
Line 53, "one-side" should read --one-sided--.

COLUMN 9:
Line 2, "thickness" should read --thickness is--;
Line 8, "the" should be deleted;
Line 9, "belt" should read --the belt--;
Line 31, "the scattering on belt" should read --scattering on the belt--; and
Line 65, "of" should read --of the--.

COLUMN 13:
Line 41, "of" should read --of the--.

COLUMN 15:
Line 12, "of" should read --of the--.

UNITED STATES PATENT AND TRADEMARK OFFICE

CERTIFICATE OF CORRECTION

PATENT NO. : 5,978,638

DATED : November 2, 1999

INVENTOR(S): ATSUSHI TANAKA, ET AL.

It is certified that error appears in the above-identified patent and that said Letters Patent is hereby corrected as shown below:

COLUMN 16:

Line 12, "of" should read --of the--; and

Line 59, "coating, it" should read --coating, and--.

Signed and Sealed this

First Day of August, 2000

*Attest:*

Q. TODD DICKINSON

*Attesting Officer*

*Director of Patents and Trademarks*